US009516420B2

(12) United States Patent
Kim et al.

(10) Patent No.: US 9,516,420 B2
(45) Date of Patent: Dec. 6, 2016

(54) TRANSDUCER AND ELECTRONIC DEVICE INCLUDING THE SAME

(71) Applicant: Samsung Display Co., Ltd., Yongin, Gyeonggi-do (KR)

(72) Inventors: Ilnam Kim, Yongin (KR); Changhoon Lee, Yongin (KR); Mingyeong Jo, Yongin (KR); Jongheon Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/616,494

(22) Filed: Feb. 6, 2015

(65) Prior Publication Data

US 2016/0014521 A1 Jan. 14, 2016

(30) Foreign Application Priority Data

Jul. 8, 2014 (KR) ..... 10-2014-0085366

(51) Int. Cl.
*H04R 25/00* (2006.01)
*H04R 7/16* (2006.01)
(Continued)

(52) U.S. Cl.
CPC ..... *H04R 7/16* (2013.01); *B06B 1/0292* (2013.01); *H04R 7/18* (2013.01); *H04R 19/00* (2013.01); *H04R 31/006* (2013.01); *H04R 17/00* (2013.01); *H04R 2307/023* (2013.01); *H04R 2307/025* (2013.01); *H04R 2400/01* (2013.01); *H04R 2400/11* (2013.01); *H04R 2499/11* (2013.01)

(58) Field of Classification Search
CPC ..... H04R 19/04; H04R 19/02; H04R 2400/01; H01G 5/011; H01G 5/019; H01G 5/16
See application file for complete search history.

(56) References Cited

U.S. PATENT DOCUMENTS 1,550,381 A * 8/1925 Massolle ..... H04R 19/02 381/174
2,852,620 A * 9/1958 Schoeps et al. ..... H04R 1/38 381/165
(Continued)

FOREIGN PATENT DOCUMENTS

GB 334606 A * 9/1930 ..... H04R 19/00
KR 10-2000-0062580 A 10/2000
(Continued)

*Primary Examiner* — Curtis Kuntz
*Assistant Examiner* — Ryan Robinson
(74) *Attorney, Agent, or Firm* — Knobbe, Martens, Olson & Bear, LLP

(57) ABSTRACT

A transducer and electronic device including the same are disclosed. In one aspect, the transducer includes a first electrode and a membrane arranged over the first electrode and spaced apart from the first electrode. The membrane at least partially overlaps the first electrode. The transducer also includes a first support member that supports the membrane. The membrane includes a vibrating portion that is movable in a direction substantially perpendicular to the membrane and a fixed portion that is supported by the first support member. The first support member is configured to adjust the distance between the fixed portion and the first electrode.

18 Claims, 6 Drawing Sheets

(51) Int. Cl.

| | |
|---|---|
| ***H04R 7/18*** | (2006.01) |
| ***H04R 19/00*** | (2006.01) |
| ***H04R 31/00*** | (2006.01) |
| ***B06B 1/02*** | (2006.01) |
| *H04R 17/00* | (2006.01) |

(56) References Cited

U.S. PATENT DOCUMENTS

| | | | | |
|---|---|---|---|---|
| 6,420,818 | B1 | 7/2002 | Kishimoto et al. | |
| 6,898,450 | B2 * | 5/2005 | Eden | H01P 7/082 333/174 |
| 7,305,096 | B2 * | 12/2007 | Su | H04R 19/04 381/174 |
| 7,781,935 | B2 * | 8/2010 | Jager | B81B 3/0086 310/309 |
| 8,081,782 | B2 * | 12/2011 | Klinghult | H04R 1/222 381/162 |
| 9,107,008 | B2 * | 8/2015 | Leitner | H04R 1/083 |
| 2003/0123683 | A1 * | 7/2003 | Raicevich | H04R 19/04 381/174 |
| 2005/0163336 | A1 | 7/2005 | Hiramoto et al. | |
| 2012/0057730 | A1 | 3/2012 | Fujise et al. | |
| 2012/0097636 | A1 | 4/2012 | Bachman et al. | |

FOREIGN PATENT DOCUMENTS

| | | | |
|---|---|---|---|
| KR | 10-0966756 | B1 | 6/2010 |
| KR | 10-2012-0017384 | A | 2/2012 |
| KR | 10-2014-0024124 | A | 2/2014 |

* cited by examiner

TRANSDUCER AND ELECTRONIC DEVICE INCLUDING THE SAME

RELATED APPLICATION

This application claims the benefit of Korean Patent Application No. 10-2014-0085366, filed on Jul. 8, 2014, in the Korean Intellectual Property Office, the disclosure of which is incorporated herein in its entirety by reference.

BACKGROUND

1. Field

The described technology generally relates to a transducer and an electronic device including the same.

2. Description of the Related Technology

Transducers are devices that can convert one form of energy into another. For example, a transducer may convert an electrical signal into acoustic energy or may convert acoustic energy into an electrical signal.

Transducers are manufactured with a variety of structures based on the types of energy converted. For example, an acoustic transducer may include a fixed electrode and a movable electrode that is spaced apart from the fixed electrode.

Acoustic transducers can generate acoustic waves by causing the movable electrode to vibrate in response to an electrostatic force that is generated between the fixed electrode and the movable electrode, and thus the transducers can be used as a speaker. Alternatively, the movable electrode of an acoustic transducer can vibrate in response to a change in an external pressure and convert the received acoustic energy into an electrical signal based on a change in a capacitance between the fixed electrode and the movable electrode which occurs when the movable electrode vibrates, and thus can be used as a microphone.

SUMMARY OF CERTAIN INVENTIVE ASPECTS

One inventive aspect is a transducer and an electronic device including the same which may be used in various applications and may have various characteristics by changing the distance between a fixed electrode and a movable electrode.

Additional aspects will be set forth in part in the description which follows and, in part, will be apparent from the description, or may be learned by practice of the presented embodiments.

Another aspect is a transducer includes: a first electrode; a membrane that is arranged over the first electrode to be spaced apart from the first electrode and includes at least a portion that overlaps the first electrode; and a support member that supports the membrane such that the membrane is spaced apart from the first electrode, wherein the membrane includes a vibrating portion that is movable in a vertical direction and a fixed portion that is supported by the support member, and wherein the support member is configured to adjust the distance between the fixed portion and the first electrode.

The height of the support member may be changed when an electrical signal is applied to the support member.

The support member may include an electroactive polymer (EAP).

The transducer may further include: a second electrode that is arranged over the membrane to be spaced apart from the membrane and includes at least a portion that overlaps the membrane; and a second support member that supports the second electrode such that the second electrode is spaced apart from the membrane.

The second support member may be configured to adjust the distance between the fixed portion and the second electrode.

The height of the second support member may be changed when an electrical signal is applied to the second support member.

The second support member may include an electroactive polymer (EAP).

An insulator may be interposed between the support member and the membrane. An insulator may be interposed between the second support member and the membrane and between the second support member and the second electrode.

Another aspect is a transducer comprising a first electrode; a membrane arranged over the first electrode and spaced apart from the first electrode, wherein the membrane at least partially overlaps the first electrode; and a first support member that supports the membrane such that the membrane is spaced apart from the first electrode, wherein the membrane comprises i) a vibrating portion that is movable in a direction substantially perpendicular to the membrane and ii) a fixed portion that is supported by the first support member, and wherein the first support member is configured to adjust the distance between the fixed portion and the first electrode.

In certain embodiments, the first support member is further configured to adjust its height when an electrical signal is applied to the first support member. The first support member can comprise an electroactive polymer (EAP). The transducer can further comprise a second electrode that is arranged over the membrane and spaced apart from the membrane, wherein the second electrode at least partially overlaps the membrane and a second support member that supports the second electrode such that the second electrode is spaced apart from the membrane. The second support member can be configured to adjust the distance between the fixed portion and the second electrode. The second support member can be further configured to adjust its height when an electrical signal is applied to the second support member.

In certain embodiments, the second support member comprises an electroactive polymer (EAP). The transducer can further comprise a first insulator interposed between the second support member and the membrane and a second insulator interposed between the second support member and the second electrode. The second electrode can comprise a plurality of holes that are formed therein. The transducer can further comprise an insulator interposed between the first support member and the membrane.

Another aspect is an electronic device comprising a transducer including: a first electrode; a membrane arranged over the first electrode and spaced apart from the first electrode, wherein the membrane at least partially overlaps the first electrode; and a first support member that supports the membrane such that the membrane is spaced apart from the first electrode, wherein the membrane comprises i) a vibrating portion that is movable in a direction substantially perpendicular to the membrane and ii) a fixed portion that is supported by the first support member and wherein the first support member is configured to adjust the distance between the fixed portion and the first electrode.

In certain embodiments, the first support member is further configured to adjust its height when an electrical signal is applied to the first support member. The first support member can comprise an electroactive polymer (EAP). The transducer can further comprise a second electrode arranged over the membrane and spaced apart from the membrane, wherein the second electrode at least partially overlaps the membrane and a second support member that supports the second electrode such that the second electrode is spaced apart from the membrane. The second support member can be configured to adjust the distance between the fixed portion and the second electrode.

In certain embodiments, the second support member is further configured to adjust its height when an electrical signal is applied to the second support member. The second support member can comprise an electroactive polymer (EAP). The electronic device can further comprise a first insulator interposed between the second support member and the membrane and a second insulator interposed between the second support member and the second electrode. The second electrode can comprise a plurality of holes that are formed therein. The electronic device can further comprise an insulator interposed between the first support member and the membrane.

According to at least one embodiment, an electronic device includes a transducer.

The above and other features and advantages of the described technology will become more apparent from the drawings, the appended claims, and the detailed description.

These general and specific embodiments may be implemented by using a system, a method, a computer program, or a combination of the system, the method, and the computer program.

The transducer and the electronic device including the same according to at least one embodiment may be used in various applications and may have various characteristics by changing a distance between a fixed electrode and a movable electrode.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION OF CERTAIN INVENTIVE EMBODIMENTS

Figure 1:
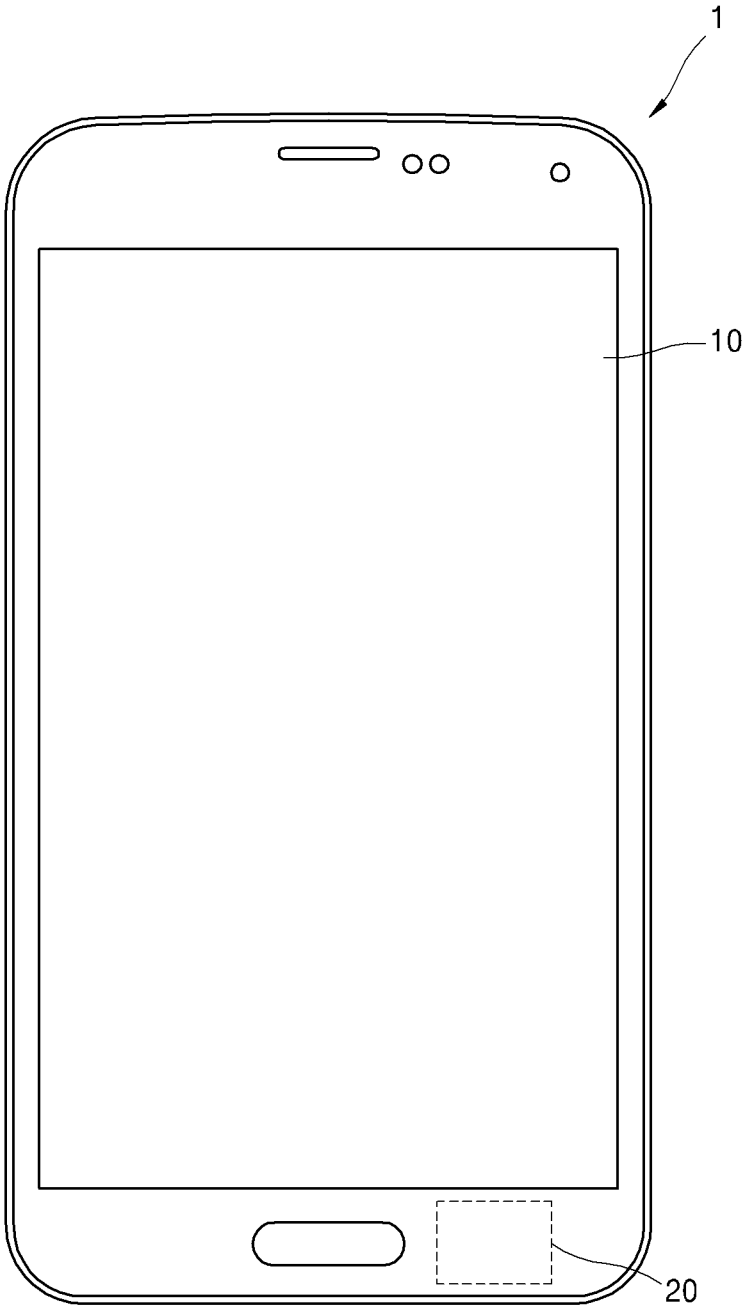
FIG. 1 is a plan view illustrating an electronic device according to an embodiment.

The distance between the fixed electrode and the movable electrode of an acoustic transducer that is used as a speaker is different from the distance between the fixed and moveable electrodes of a similar transducer that is used as a microphone. Accordingly, when a speaker transducer is used as a microphone, a relatively large amount of noise may be introduced into the received acoustic waves. In contrast, when a microphone transducer is used as a speaker, sound pressure that is output by the speaker can be very limited.

The advantages and features of the described technology and methods of achieving the same will be described more fully with reference to the accompanying drawings, in which exemplary embodiments are shown. The described technology may, however, be embodied in many different forms and should not be construed as being limited to the embodiments set forth herein.

The described technology will become more apparent to one of ordinary skill in the art by describing in detail exemplary embodiments thereof with reference to the accompanying drawings. In the drawings, the same reference numerals denote the same members.

It will be understood that although the terms "first", "second", etc. may be used herein to describe various elements, these elements should not be limited by these terms. These elements are only used to distinguish one element from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

It will be understood that when a layer, region, or element is referred to as being "formed on," another layer, region, or element, it can be directly or indirectly formed on the other layer, region, or element. That is, for example, intervening layers, regions, or elements may also be present.

The sizes and dimensions of elements in the drawings may be exaggerated for the sake of clarity. In other words, since the sizes and thicknesses of elements in the drawings may be exaggerated for the sake of clarity, the following embodiments are not limited thereto.

When a certain embodiment may be implemented differently, the specific process order may be performed differently from the described order. For example, two consecutively described processes may be performed substantially at the same time or performed in an order opposite to the described order.

As used herein, the term "and/or" includes any and all combinations of one or more of the associated listed items. Expressions such as "at least one of," when preceding a list of elements, modify the entire list of elements and do not modify the individual elements of the list.

FIG. 1 is a plan view illustrating an electronic device 1 according to an embodiment. Referring to FIG. 1, the electronic device 1 includes a display module 10 and at least one transducer 20.

Examples of the electronic device 1 may include, but are not limited to, a smart phone, a laptop computer, a tablet PC, an e-book reader, a digital broadcasting terminal, a personal digital assistant (PDA), a portable multimedia player (PMP), a navigation system, an MP3 player, a digital camera, and a wearable device (e.g., glasses or a wristwatch).

The display module 10 includes a display panel on which an image is formed. The display device may be an organic light-emitting diode (OLED) panel, a liquid crystal display (LCD) panel, or an electrophoresis display (EPD) panel. In some embodiments, the display module 10 includes a touch panel.

The transducer 20 can emit acoustic waves or ultrasonic waves and can receive acoustic waves or ultrasonic waves that are generated external to the electronic device 1. For example, the transducer 20 of the electronic device 1 can function as a speaker that outputs acoustic waves or as a microphone that receives acoustic waves. The term "acoustic waves" used herein refers to waves with an audible frequency ranging from about 16 Hz to about 20,000 Hz and the term "ultrasonic waves" used herein refers to waves with a frequency greater than the upper limit (20,000 Hz) of the audible frequency.

Figure 2:
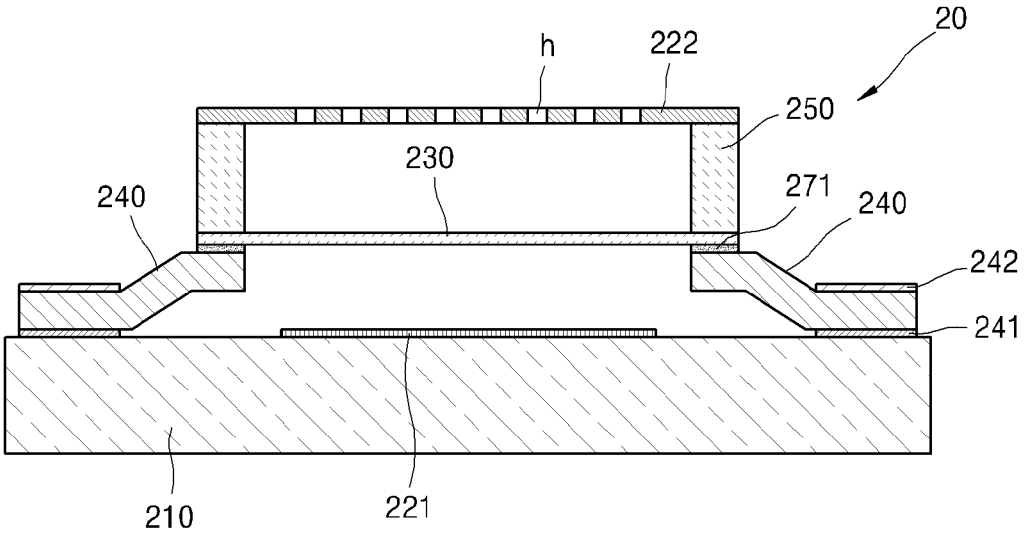
FIG. 2 is a cross-sectional view illustrating a transducer of the electronic device of FIG. 1.
Figure 3:
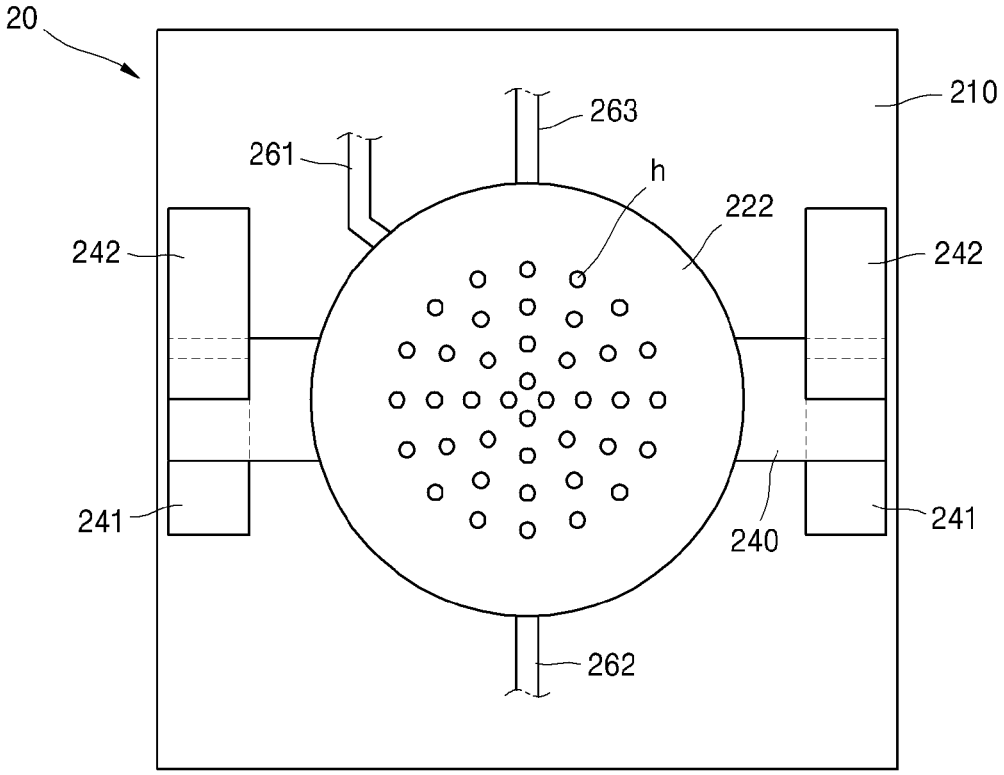
FIG. 3 is a plan view illustrating the transducer of FIG. 2.

FIG. 2 is a cross-sectional view illustrating the transducer 20 of FIG. 1. FIG. 3 is a plan view illustrating the transducer 20 of FIG. 2.

Referring to FIGS. 2 and 3, the transducer 20 includes a substrate 210, a first electrode 221 that is fixed to the substrate 210, and a membrane 230 that is arranged over the first electrode 221 and spaced apart from the first electrode 221. The transducer 20 further includes a second electrode 222 that is arranged over the membrane 230 and spaced apart from the membrane 230, a support member 240 that supports the membrane 230, and a second support member 250 that supports the second electrode 222.

The substrate 210 fixedly supports the first electrode 221. The substrate 210 may be a glass substrate or a silicon substrate. However, the material of the substrate 210 is not limited thereto and any of various materials that are used for the substrate 210 in the art may be used. Also, the substrate 210 may be a substrate that may not be easily bent or a flexible substrate that may be easily bent, based on its material.

The first electrode 221 is formed on the substrate 210. The first electrode 221 may have a substantially circular shape. The first electrode 221 is fixed to the substrate 210. A first signal line 261 is connected to the first electrode 221. A direct current (DC) voltage or an alternating current (AC) voltage may be applied through the first signal line 261 to the first electrode 221. The first electrode 221 may include at least one of the following materials: copper (Cu), indium tin oxide (ITO), chromium (Cr), and gold (Au).

The membrane 230 is arranged over the first electrode 221 and spaced apart from the first electrode 221. The membrane 230 may have a shape corresponding to that of the first electrode 221. For example, the membrane 230 may have a substantially circular shape. The membrane 230 may include at least one selected of the following materials: graphene, graphite, polyimide, polyamide, and polymethyl methacrylate (PMMA).

The membrane 230 is arranged such that at least a portion of the membrane 230 overlaps the first electrode 221. A second signal line 262 is connected to the membrane 230. A DC voltage may be applied through the second signal line 262 to the membrane 230. The membrane 230 includes a conductive film.

The membrane 230 may have a stiffness which is less than that of the first electrode 221. Accordingly, the first electrode 221 may function as a fixed electrode and the membrane 230 may function as a movable electrode.

The second electrode 222 is arranged over the membrane 230 and spaced apart from the membrane 230. The second electrode 222 may have a shape corresponding to that of the first electrode 221. For example, the second electrode 222 may have a substantially circular shape. The second electrode 222 may include at least one of the following materials: from Cu, ITO, Cr, and Au.

At least a portion of the second electrode 222 overlaps the membrane 230. A third signal line 263 is connected to the second electrode 222. An AC voltage may be applied through the third signal line 263 to the second electrode 222.

The second electrode 222 may have a stiffness which is greater than that of the membrane 230. Accordingly, the second electrode 222 may function as a fixed electrode and the membrane 230 may function as a movable electrode.

A basic operation of the transducer 20 will now be explained in detail with reference to FIG. 4.

Figure 4:
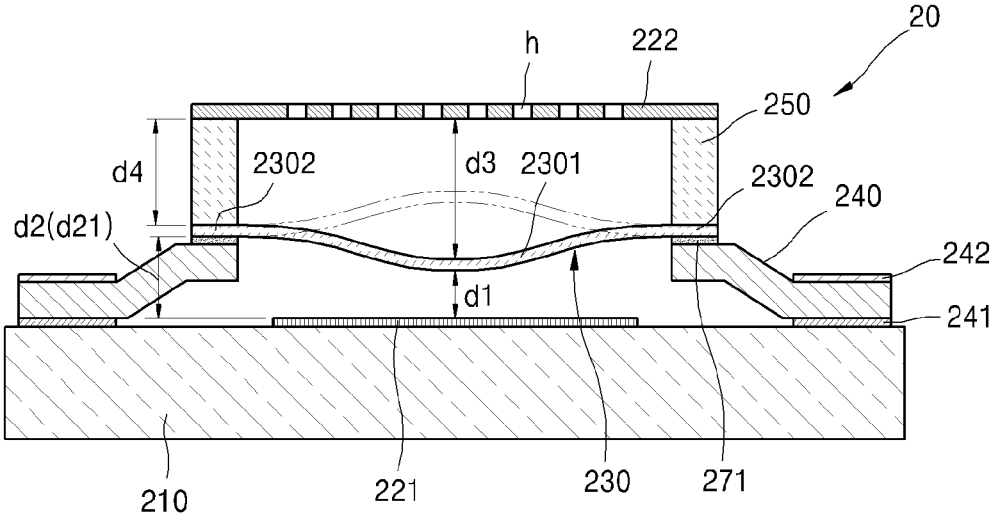
FIG. 4 is a cross-sectional view for explaining the operation of the transducer of FIG. 2.

FIG. 4 is a cross-sectional view for explaining the operation of the transducer 20 of FIG. 2. Referring to FIG. 4, the membrane 230 of the transducer 20 can vibrate in a vertical direction, i.e., in a first direction that is substantially perpendicular to the surfaces of the membrane. The transducer 20 that vibrates in the vertical direction can generate acoustic waves or ultrasonic waves or can receive external acoustic waves or external ultrasonic waves. The term "vertical direction" used herein encompasses both a direction in which the membrane 230 vibrates farther away from the first electrode 221 and a direction in which the membrane 230 vibrates closer to the first electrode 221.

For example, when electrical signals are applied to the first electrode 221, the second electrode 222, and the membrane 230, the membrane 230 vibrates in the vertical direction due to an electrostatic force that is generated between the first electrode 221, the second electrode 222, and the membrane 230.

AC voltages having polarities which are periodically changed can be applied to the first electrode 221 and the second electrode 222, and a DC voltage having a constant polarity can be applied to the membrane 230. In some embodiments, the AC voltages that are applied to the first electrode 221 and the second electrode 222 have opposite polarities. For example, when a positive (+) voltage is applied to the first electrode 221, a negative (−) voltage is applied to the second electrode 222 and when a negative (−) voltage is applied to the first electrode 221, a positive (+) voltage is applied to the second electrode 222. Accordingly, when a repulsive force is applied between the first electrode 221 and the membrane 230, an attractive force is applied between the second electrode 222 and the membrane 230. Similarly, when an attractive force is applied between the first electrode 221 and the membrane 230, a repulsive force is applied between the second electrode 222 and the membrane 230. As AC voltages having opposing polarities are applied to the first and second electrodes 221 and 222, a repulsive force and an attractive force are repeatedly applied between the first electrode 221 and the membrane 230 and an attractive force and a repulsive force that are opposite in terms of the direction of a generated electrostatic force applied between the first electrode 221 and the membrane 230 are repeatedly applied between the second electrode 222 and the membrane 230. Accordingly, the membrane 230 vibrates at a predetermined amplitude and a predetermined frequency. As the membrane 230 vibrates, acoustic waves or ultrasonic waves can be generated.

Alternatively, the membrane 230 may vibrate due to a change in an external pressure. For example, the membrane 230 can vibrate due to acoustic waves or ultrasonic waves that are generated external to the transducer 20. DC voltages can be applied to the membrane 230 and the first electrode 221. As the membrane 230 vibrates, the distance between the membrane 230 and the first electrode 221 is changed. As the distance between the membrane 230 and the first electrode 221 is changed, the capacitance that is formed between the membrane 230 and the first electrode 221 is changed. The transducer 20 can receive acoustic waves or ultrasonic waves that are generated external to the transducer 20 and generate a corresponding electrical signal based on the change in the capacitance.

As described above, the membrane 230 can vibrate due to a change in an external pressure or an electrostatic force. The vibrating membrane 230 is supported by the support member 240.

The support member 240 supports the membrane 230 such that the membrane 230 is spaced apart from the first electrode 221. The support member 240 fixes a first portion of the membrane 230 such that the remaining portions of the membrane 230 are allowed to vibrate.

The membrane 230 includes a fixed portion 2302 that is supported by the support member 240 and a vibrating portion 2301 that is movable in the vertical direction. The vibrating portion 2301 extends from the fixed portion 2302.

Since the fixed portion 2302 of the membrane 230 is supported by the support member 240, even when the membrane 230 vibrates, the fixed portion 2302 is not affected by the vibration. Accordingly, the distance d2 between the fixed portion 2302 and the first electrode 221 is not changed due to the vibration of the membrane 230. In other words, when the membrane 230 vibrates, the distance d1 between the vibrating portion 2301 and the first electrode 221 is changed whereas the distance d2 between the fixed portion 2302 and the first electrode 221 is not changed. The distance d1 between the vibrating portion 2301 and the first electrode 221 is a vertical distance between a top surface of the first electrode 221 and a bottom surface of the vibrating portion 2301 and the distance d2 between the fixed portion 2302 and the first electrode 221 is a vertical distance between the top surface of the first electrode 221 and a bottom surface of the fixed portion 2302.

The distance d2 between the first electrode 221 and the fixed portion 2302 of the membrane 230 can be altered based on the use and characteristics of the transducer 20. This is because a vibration range of the vibrating portion 2301 of the membrane 230 may vary or an electrostatic force that may be applied to the vibrating portion 2301 may vary based on the distance d2 between the first electrode 221 and the fixed portion 2302 of the membrane 230.

For example, when the distance d2 between the first electrode 221 and the fixed portion 2302 of the membrane 230 is less than about 100 μm, the membrane 230 of the transducer 20 may vibrate due to even relatively low external sound, and thus can be used as a microphone. When the distance d2 between the first electrode 221 and the fixed portion 2302 of the membrane 230 is equal to or greater than about 100 μm, the membrane 230 of the transducer 20 may have a sufficient vibration range, and thus can be used as a speaker. When the distance d2 between the first electrode 221 and the fixed portion 2302 of the membrane 230 is about 105 μm, the transducer 20 can be used as a speaker that generates high-pitched sound and when the distance d2 between the first electrode 221 and the fixed portion 2302 of the membrane 230 is about 200 μm, the transducer 20 can be used as a speaker that generates middle and low-pitched sound.

The support member 240 of the transducer 20 can adjust the distance d2 between the first electrode 221 and the fixed portion 2302 of the membrane 230. A single transducer 20 can be used in various applications and can have various characteristics by adjusting the distance d2 between the first electrode 221 and the fixed portion 2302. For example, the transducer 20 can be not only used as a speaker and a microphone but can also adjust the sound pressure that is generated or can adjust the sensitivity at which acoustic waves are received.

When the distance d2 between the first electrode 221 and the fixed portion 2302 of the membrane 230 is fixed, in contrast to the present embodiment, the use of the transducer 20 is limited. This is because the distance d2 between the first electrode 221 and the fixed portion 2302 of the membrane 230 that is necessary to use the transducer 20 as a speaker is different from the distance d2 between the first electrode 221 and the fixed portion 2302 of the membrane 230 that is necessary to use the transducer 20 as a microphone. For example, when the transducer 20 for a speaker is used as a microphone without adjusting the distance d2 between the first electrode 221 and the fixed portion 2302 of the membrane 230, a large amount of noise may be present in the received acoustic waves. In contrast, when the transducer 20 for a microphone is used as a speaker without adjusting the distance d2 between the first electrode 221 and the fixed portion 2302 of the membrane 230, the sound that is output may be very limited. Also, when the distance d2 between the first electrode 221 and the fixed portion 2302 of the membrane 230 is fixed, it is difficult to adjust the frequency range of the transducer 20, the sound pressure, or the sensitivity at which the transducer 20 receives acoustic waves.

However, since the transducer 20 according to the at least one embodiment adjusts the distance d2 between the first electrode 221 and the fixed portion 2302, a single transducer 20 can be used in various applications and can have various characteristics.

Figure 5:
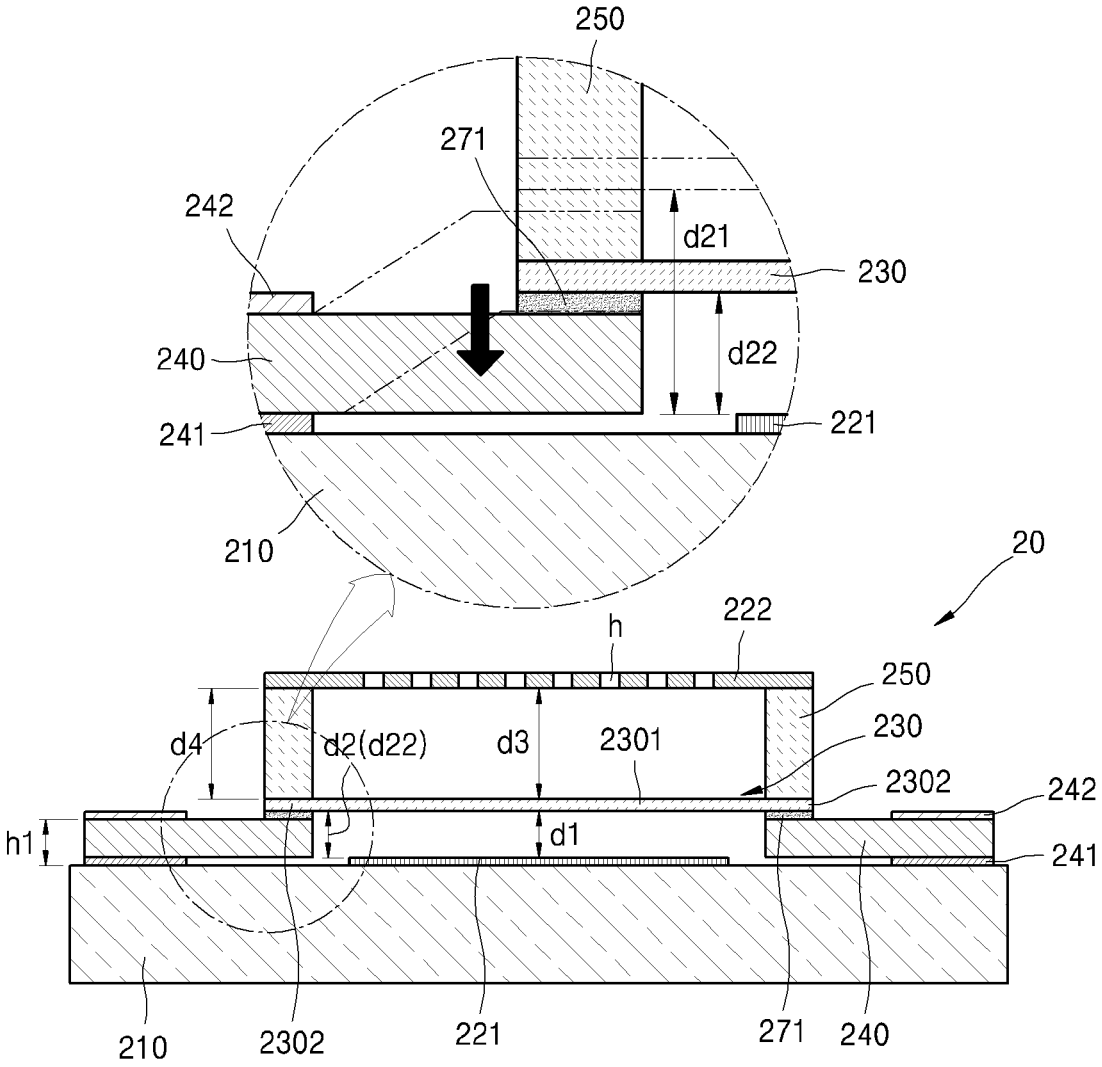
FIG. 5 is a cross-sectional view illustrating an example where the distance between a fixed portion and a first electrode is changed due to a support member of the transducer of FIG. 1.

FIG. 5 is a cross-sectional view illustrating an example where the distance d2 between the first electrode 221 and the fixed portion 2302 is changed due to the support member 240 of the transducer 20 of FIG. 1.

Referring to FIG. 5, in order to adjust the distance d2 between the first electrode 221 and the fixed portion 2302 of the membrane 230 by using the support member 240, the height h1 can be changed based on an electrical signal applied to the support member 240. Electrodes 241 and 242 are formed above and below the support member 240 such that an electrical signal is applied to the support member 240. The height h1 is a distance between the substrate 210 and an uppermost surface of the support member 240.

An electrical insulator 271 is arranged between the support member 240 and the membrane 230.

The support member 240 may include an electroactive polymer (EAP). EAPs can be classified into ionic EAPs and electronic EAPs based on their actuation method. An ionic EAP contracts and expands due to mobility and diffusion of ions when a voltage is applied and may include at least one of the following: an electrorheological fluid (ERP), carbon nanotubes (CNTs), a conductive polymer (CP), an ionic polymer-metal composite (IPMC), and an ionic polymer gel (IPG). An electronic EAP is deformed due to polarization and may include at least one of the following: a liquid crystal elastomer (LCE), an electro-viscoelastic elastomer, a dielectric elastomer, and a ferroelectric polymer.

When an electrical signal is applied to the support member 240, the distance d2 between the first electrode 221 and the fixed portion 2302 can be reduced. The distance d22 between the first electrode 221 and the fixed portion 2302 when an electrical signal is applied to the support member 240 is less than the distance d21 between the first electrode 221 and the fixed portion 2302 before the electrical signal is applied to the support member 240.

The distance d22 between the first electrode 221 and the fixed portion 2302 when the electrical signal is applied to the support member 240 may be reduced by about 10% of the distance d21 between the first electrode 221 and the fixed portion 2302 or greater before the electrical signal is applied to the support member 240.

For example, the distance d21 between the first electrode 221 and the fixed portion 2302 before the electrical signal is applied to the support member 240 may be about 200 μm. Accordingly, the vibrating portion 2301 of the membrane 230 may vibrate such that the distance d1 between the first electrode 221 and the vibrating portion 2301 ranges from about 100 μm to about 300 μm. In this embodiment, acoustic waves that are generated by the membrane 230 may be middle and low-pitched sound.

The distance d22 between the first electrode 221 and the fixed portion 2302 when the electrical signal is applied to the support member 240 may be about 105 μm. Accordingly, the vibrating portion 2301 of the membrane 230 may vibrate such that the distance d1 between the first electrode 221 and the vibrating portion 2301 ranges from about 10 μm to about 200 μm. In this embodiment, acoustic waves that are generated by the membrane 230 may be high-pitched sound.

As such, the distance d2 between the first electrode 221 and the fixed portion 2302 can be adjusted by simply applying an electrical signal to the support member 240. Accordingly, a user can easily adjust the use and characteristics of the transducer 20.

The second support member 250 is arranged over the membrane 230. The second electrode 222 is placed on the second support member 250. The second support member 250 supports the second electrode 222 such that the second electrode 222 is spaced apart from the membrane 230.

The second support member 250 includes an electrically insulating material that insulates the membrane 230 from the second electrode 222. For example, the second support member 250 may include at least one of the following materials: polyimide, polyester, and polyvinyl chloride.

When the membrane 230 vibrates, the fixed portion 2302 is not affected by the vibration. Accordingly, the distance d4 between the second electrode 222 and the fixed portion 2302 is not changed due to the vibration of the membrane 230. In other words, when the membrane 230 vibrates, the distance d3 between the second electrode 222 and the vibrating portion 2301 is changed whereas the distance d4 between the second electrode 222 and the fixed portion 2302 is not changed. The distance d3 between the second electrode 222 and the vibrating portion 2301 is the vertical distance between a top surface of the vibrating portion 2301 and a bottom surface of the second electrode 222 and the distance d4 between the second electrode 222 and the fixed portion 2302 is the vertical distance between a top surface of the fixed portion 2302 and the bottom surface of the second electrode 222.

For example, acoustic waves or ultrasonic waves that are generated as the membrane 230 vibrates may be emitted from the transducer 20 through a plurality of holes h that are formed in the second electrode 222. Alternatively, acoustic waves or ultrasonic waves that are generated external to the transducer 20 may be transmitted to the membrane 230 through the holes h that are formed in the second electrode 222, and thus the membrane 230 may vibrate.

An example where the support member 240 is bent and thus the height h1 is reduced when an electrical signal is applied to the support member 240 has been described. However, a change in the height h1 of the support member 240 is not limited thereto. For example, when an electrical signal is applied to the support member 240, the support member 240 may be bent and thus the height h1 may be increased. Alternatively, when an electrical signal is applied to the support member 240, the thickness of the support member 240 may be changed and thus the height h1 may be increased or reduced.

In addition, the material of the support member 240 is not limited to an EAP, and any of other materials may be used as long as the height h1 can be changed based on an electrical signal. For example, the support member 240 may include a piezoelectric material.

Figure 6:
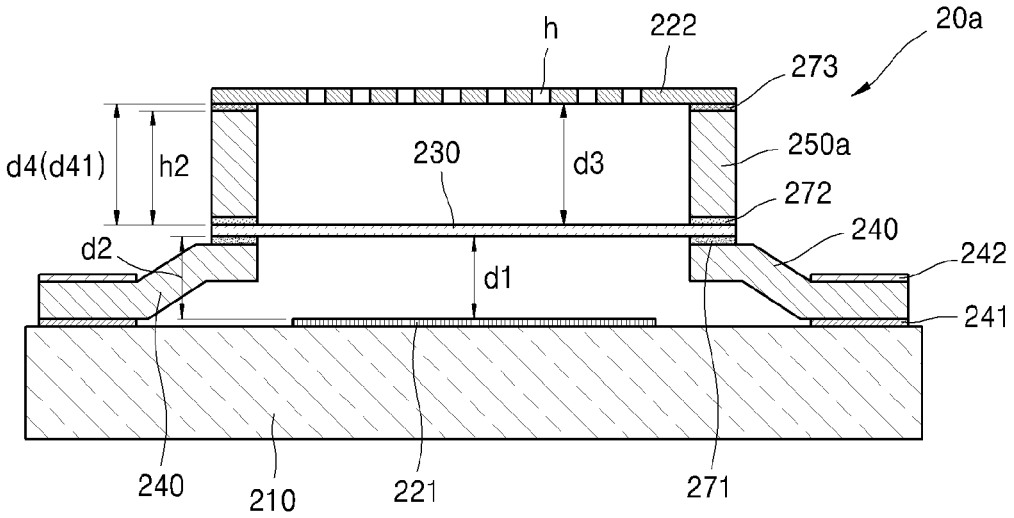
FIG. 6 is a cross-sectional view illustrating a transducer according to another embodiment.
Figure 7:
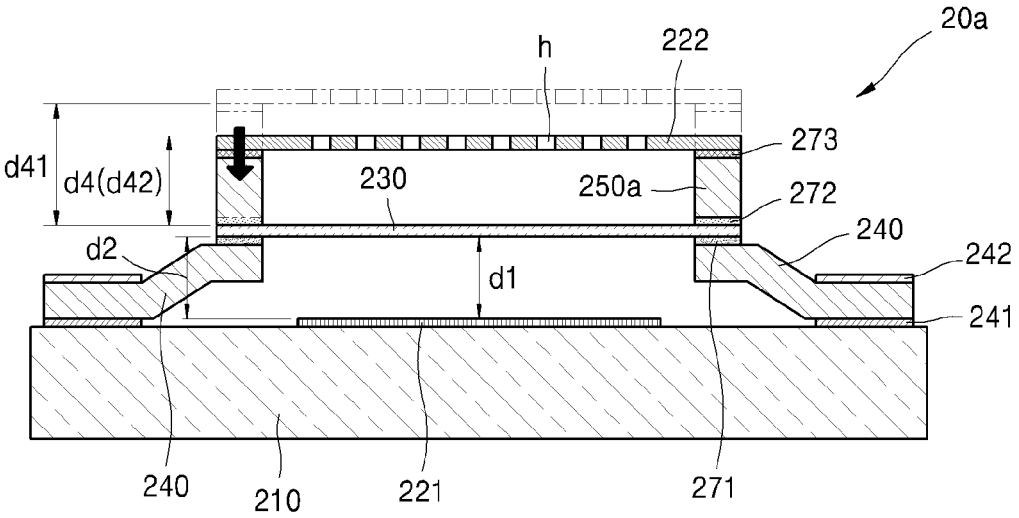
FIG. 7 is a cross-sectional view illustrating an example where the distance between the fixed portion and a second electrode is changed due to a second support member of the transducer of FIG. 6.

FIG. 6 is a cross-sectional view illustrating a transducer 20*a* according to another embodiment. FIG. 7 is a cross-sectional view illustrating an example where the distance d4 between the second electrode 222 and the fixed portion 2302 is changed due to a second support member 250*a* of the transducer 20*a* of FIG. 6. The same elements are denoted by the same reference numerals and repeated explanations thereof will not be given.

Referring to FIG. 6, the transducer 20*a* includes the substrate 210, the first electrode 221 that is fixed to the substrate 210, and the membrane 230 that is arranged over the first electrode 221 and spaced apart from the first electrode 221. The transducer 20*a* further includes the second electrode 222 that is arranged over the membrane 230 and spaced apart from the membrane 230, the support member 240 that supports the membrane 230, and the second support member 250*a* that supports the second electrode 222.

The second support member 250*a* of the transducer 20*a* can adjust the distance d4 between the second electrode 222 and the fixed portion 2302.

When an electrical signal is applied to the second support member 250*a*, the height h2 may be changed. The height h2 is the distance between the top surface of the fixed portion 2302 of the membrane 230 and an uppermost surface of the second support member 250*a*.

In order to change the height h2 of the second support member 250*a* when an electrical signal is applied, the second support member 250*a* may include an EAP. EAPs can be classified into ionic EAPs and electronic EAPs based on their actuation method. An ionic EAP that contracts and expands due to mobility and diffusion of ions when a voltage is applied may include at least one of the following materials: an ERP, CNTs, a CP, an IPMC, and an IPG. An electronic EAP that is deformed due to polarization may include at least one of the following materials: a LCE, an electro-viscoelastic elastomer, a dielectric elastomer, and a ferroelectric polymer.

However, the material of the second support member 250*a* is not limited to an EAP, and any of other materials may be used as long as the height h2 can be changed when an electrical signal is applied. For example, the second support member 250*a* may include a piezoelectric body.

Electrodes (not shown) that apply an electrical signal to the second support member 250 are formed above and below the second support member 250*a*. Insulators 272 and 273 may be arranged between the second support member 250*a* and the membrane 230 and between the second support member 250*a* and the second electrode 222.

Referring to FIG. 7, the distance d4 between the second electrode 222 and the fixed portion 2302 can be reduced when an electrical signal is applied to the second support member 250*a*. The distance d42 between the second electrode 222 and the fixed portion 2302 when an electrical signal is applied to the second support member 250*a* may be less than the distance d41 between the second electrode 222 and the fixed portion 2302 before the electrical signal is applied to the second support member 250*a*.

As such, the user can easily adjust an electrostatic force that is applied between the second electrode 222 and the membrane 230 by adjusting the distance d4 between the second electrode 222 and the fixed portion 2302 by using the second support member 250*a*.

In the present embodiment, the characteristics of the transducer 20*a* can be more precisely adjusted by adjusting the distance d2 between the first electrode 221 and the fixed portion 2302 of the membrane 230 by using the support member 240 and by adjusting the distance d4 between the second electrode 222 and the fixed portion 2302 of the membrane 230 by using the second support member 250*a*.

Figure 8:
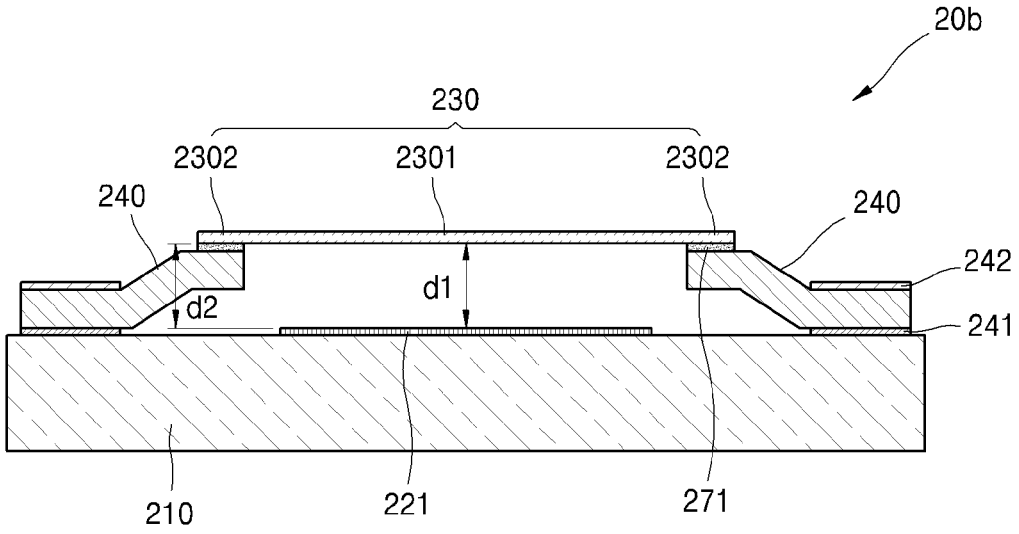
FIG. 8 is a cross-sectional view illustrating a transducer according to another embodiment.

An example where the second support member 250 or 250*a* and the second electrode 222 are arranged over the membrane 230 has been described in the above embodiments. However, the second support member 250 or 250*a* and the second electrode 222 may be optional elements and thus may be included in the transducer 20 or 20*a* if desired. For example, as shown in FIG. 8, a transducer 20*b* can include the substrate 210, the first electrode 221 that is fixed to the substrate 210, the membrane 230 that is arranged over the first electrode 221 and spaced apart from the first electrode 221, and the support member 240 that supports the membrane 230, and does not include the second support member 250 or 250*a* and the second electrode 222.

While one or more embodiments of the inventive technology have been described with reference to the figures, it will be understood by those of ordinary skill in the art that various changes in form and details may be made therein without departing from the spirit and scope of the invention as defined by the following claims. Accordingly, the technical scope of the invention is defined by the appended claims.

What is claimed is:

1. A transducer, comprising:

a first electrode;

a membrane arranged over the first electrode and spaced apart from the first electrode, wherein the membrane at least partially overlaps the first electrode; and a first support member that supports the membrane such that the membrane is spaced apart from the first electrode, wherein the membrane comprises i) a vibrating portion that is movable in a direction substantially perpendicular to the membrane and ii) a fixed portion that is supported by the first support member, wherein the first support member is configured to adjust the distance between the fixed portion and the first electrode when an electrical signal is applied to the first support member, and wherein the first support member is further configured to adjust the distance between the fixed portion and the first electrode to: i) a first distance in response to the transducer being operated as a microphone and ii) a second distance in response to the transducer being operated as a speaker, the first distance being less than the second distance.

2. The transducer of claim 1, wherein the first support member comprises an electroactive polymer (EAP).

3. The transducer of claim 1, further comprising:

a second electrode that is arranged over the membrane and spaced apart from the membrane, wherein the second electrode at least partially overlaps the membrane; and a second support member that supports the second electrode such that the second electrode is spaced apart from the membrane.

4. The transducer of claim 3, wherein the second support member is configured to adjust the distance between the fixed portion and the second electrode.

5. The transducer of claim 3, wherein the second support member is further configured to adjust its height when an electrical signal is applied to the second support member.

6. The transducer of claim 5, wherein the second support member comprises an electroactive polymer (EAP).

7. The transducer of claim 5, further comprising:

a first insulator interposed between the second support member and the membrane; and a second insulator interposed between the second support member and the second electrode.

8. The transducer of claim 3, wherein the second electrode comprises a plurality of holes that are formed therein.

9. The transducer of claim 1, further comprising an insulator interposed between the first support member and the membrane.

10. An electronic device, comprising:

a transducer including:

a first electrode;

a membrane arranged over the first electrode and spaced apart from the first electrode, wherein the membrane at least partially overlaps the first electrode; and a first support member that supports the membrane such that the membrane is spaced apart from the first electrode, wherein the membrane comprises i) a vibrating portion that is movable in a direction substantially perpendicular to the membrane and ii) a fixed portion that is supported by the first support member, and wherein the first support member is configured to adjust the distance between the fixed portion and the first electrode when an electrical signal is applied to the first support member, and wherein the first support member is further configured to adjust the distance between the fixed portion and the first electrode to: i) a first distance in response to the transducer being operated as a microphone and ii) a second distance in response to the transducer being operated as a speaker, the first distance being less than the second distance.

11. The electronic device of claim 10, wherein the first support member comprises an electroactive polymer (EAP).

12. The electronic device of claim 10, wherein the transducer further comprises:

a second electrode arranged over the membrane and spaced apart from the membrane, wherein the second electrode at least partially overlaps the membrane; and a second support member that supports the second electrode such that the second electrode is spaced apart from the membrane.

13. The electronic device of claim 12, wherein the second support member is configured to adjust the distance between the fixed portion and the second electrode.

14. The electronic device of claim 12, wherein the second support member is further configured to adjust its height when an electrical signal is applied to the second support member.

15. The electronic device of claim 14, wherein the second support member comprises an electroactive polymer (EAP).

16. The electronic device of claim 14, further comprising:

a first insulator interposed between the second support member and the membrane; and a second insulator interposed between the second support member and the second electrode.

17. The electronic device of claim 12, wherein the second electrode comprises a plurality of holes that are formed therein.

18. The electronic device of claim 10, further comprising an insulator interposed between the first support member and the membrane.

* * * * *